US007839370B2

(12) United States Patent
Izumikawa et al.

(10) Patent No.: US 7,839,370 B2
(45) Date of Patent: Nov. 23, 2010

(54) APPARATUS AND METHOD FOR DRIVING DISPLAY PANELS FOR REDUCING POWER CONSUMPTION OF GRAYSCALE VOLTAGE GENERATOR

(75) Inventors: Masaki Izumikawa, Kanagawa (JP); Masayuki Kumeta, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 937 days.

(21) Appl. No.: 11/258,149

(22) Filed: Oct. 26, 2005

(65) Prior Publication Data

US 2006/0092114 A1 May 4, 2006

(30) Foreign Application Priority Data

Oct. 28, 2004 (JP) ..... 2004-314159

(51) Int. Cl.
*G09G 3/36* (2006.01)

(52) U.S. Cl. ..... 345/89; 345/204; 345/76; 345/55

(58) Field of Classification Search ..... 345/89, 345/204, 76, 55
See application file for complete search history.

(56) References Cited

U.S. PATENT DOCUMENTS 6,118,439 A * 9/2000 Ho et al. ..... 345/211
6,636,206 B1 * 10/2003 Yatabe ..... 345/204
7,050,028 B2 5/2006 Morita
7,180,474 B2 2/2007 Kudo et al.
7,227,517 B2 * 6/2007 Imamura ..... 345/76
7,515,145 B2 * 4/2009 Speirs ..... 345/204

FOREIGN PATENT DOCUMENTS

JP 6-348235 12/1994
JP 7-325556 12/1995
JP 8-248911 A 9/1996
JP 8-304773 A 11/1996
JP 2003-208143 A 7/2003
JP 2003-233356 A 8/2003
JP 2004-240236 A 8/2004

OTHER PUBLICATIONS

Japanese Office Action dated Jul. 27, 2009 with partial English-language translation.
Japanese Office Action dated Nov. 4, 2009 with partial Enlish-language translation.

* cited by examiner

*Primary Examiner*—Richard Hjerpe
*Assistant Examiner*—Leonid Shapiro
(74) *Attorney, Agent, or Firm*—McGinn IP Law Group, PLLC

(57) ABSTRACT

A display panel driver is composed of a grayscale voltage generator configured to develop a set of different grayscale voltages corresponding to grayscale levels of pixels within a display panel; and a plurality of grayscale selector driver circuits each of which is responsive to pixel data to select one of the grayscale voltages, and to provide a drive voltage corresponding to the selected one of the grayscale voltages for a selected pixel within the display panel. The grayscale voltage generator is allowed to output the set of grayscale voltages during a first period within a horizontal period, and prohibited from outputting the set of grayscale voltages during a second period within the horizontal period.

9 Claims, 10 Drawing Sheets

APPARATUS AND METHOD FOR DRIVING DISPLAY PANELS FOR REDUCING POWER CONSUMPTION OF GRAYSCALE VOLTAGE GENERATOR

BACKGROUND OF THE INVENTION

1. Field of the Invention

The present invention relates to apparatuses and methods for driving display panels, such as liquid crystal display panels.

2. Description of the Related Art

Recently, flat panel displays, such as liquid crystal displays (LCDs) has become mainstream of display devices. A flat panel display is designed to drive pixels arranged in rows and columns, and to thereby display a desired image on the screen. In such flat panel display, pixels are driven line by line, that is, in units of horizontal lines, to display a desired image.

FIG. 1A schematically illustrates a main part of a conventional LCD driver. The conventional LCD driver, which drives a TFT (thin film transistor) panel 70, is composed of a grayscale voltage generator 110, a set of grayscale level selectors 21, 22, . . . , 2*n*, and a set of drive circuits 31, 32, . . . , 3*n*, n being the number of pixels on each horizontal line.

As shown in FIG. 1B, the grayscale voltage generator 110 is composed of a set of serially-connected resistors 12, a set of amplifiers 114 (two shown), and another set of serially connected resistors 15. The serially-connected resistors 12 divide a power source voltage $V_H$-$V_L$ to develop a set of different voltages. The amplifiers 114 receive the set of different voltages, respectively, and develop a set of bias voltages through voltage follower operation in accordance with the received voltages on the associated nodes of the serially connected resistors 15. The serially connected resistors 15 receive the bias voltages on the nodes thereof, and develop grayscale voltages $V_0$ to $V_{63}$ through voltage dividing.

Referring back to FIG. 1A, the grayscale level selector 21 includes a set of switches selectable by pixel data. One of the switches is selected in response to the grayscale level indicated by the pixel data, and the selected switch is turned on to provide the associated graylevel voltage for the drive circuit 31. The remaining grayscale level selectors 22 to 2*n* have the same structure as the grayscale level selector 21, and select grayscale voltages for associated pixels, correspondingly.

The drive circuit 31 drives an associated pixel within the TFT panel 70 to the grayscale voltage inputted thereto. The drive voltage generated by the drive circuit 31 is referred to as the drive voltage SRC1, hereinafter. The drive circuit 31 is composed of a voltage follower amplifier 31*a*, a pair of switches 31*b* and 31*c*. When the switch 31*b* is turned on with the switch 31*c* turned off, the amplifier 31*a* rapidly drives (that is, charges or discharges) an associated drain line (or data line), which has a certain drain line capacitance 75, to the grayscale voltage inputted thereto, providing impedance matching; this operation is referred to as the "amplifier driving", hereinafter. When the switch 31*c* is turned on with the switch 31*b* turned off, on the other hand, the grayscale voltage inputted to the drive circuit 31 is transferred as it is to the associated drain line to drive the LCD capacitance 73; this operation is referred to as the "switch driving", hereinafter. The remaining drive circuits 32 to 3*n* have the same structure as the drive circuit 31, and drives the associated pixels, correspondingly.

The TFT panel 70 receives the drive voltages SRC1 to SRCn, from the driver circuits 31 to 3*n*. A set of pixels positioned on a selected horizontal line are driven at the same time by the drive voltages SRC1 to SRCn. Each pixel within the TFT panel 70 is composed of a TFT (thin film transistor) 71, a liquid crystal cell 72, and an LCD capacitance 73. Each drain line has a drain line capacitance 75. When the drive voltage SRC1 is applied to the associated drain line with the associated TFT 71 selected, the drain line capacitance 75 is charged or discharged and the liquid crystal capacitance 72 is also charged or discharged to a desired voltage. The TFT 71 is turned off after the voltage across the LCD capacitance 73 is stabilized, and the voltage is sustained across the liquid crystal capacitance 73. The liquid crystal cell 72 transmits light with a transmissivity determined by the sustained voltage.

The following is a detailed description of the grayscale voltage generator 110. In general, a grayscale voltage generator is composed of a grayscale reference voltage source generating a set of grayscale reference voltages, and a resistor divider circuit generating a desired number of grayscale voltages from the grayscale reference voltages through voltage dividing with serially connected resistors. As disclosed in Japanese Laid Open Patent Application No. JP-A-Heisei, 6-348235, a grayscale reference voltage source is designed to receive a set of reference voltages generated by a resistor divider and to output a selected number of reference voltages, providing impedance matching by a set of amplifiers. Such architecture allows easy adjustment of the resultant grayscale voltages in accordance with a desired gamma curve.

As described above, the grayscale voltage generator 110 is composed of the serially-connected resistors 12, and the amplifiers 114, and the serially-connected resistors 15. The serially-connected resistors 12, and the amplifiers 114, and the serially-connected resistors 15 function as a grayscale reference voltage source. The output voltages generated by the serially-connected resistors 15 through voltage dividing are fed to the grayscale level selectors 21, 22, . . . , 2*n*, as the grayscale voltages $V_0$ to $V_{63}$. The resistances of respective resistors within the serially-connected resistors 12 and 15, and the gains of the amplifiers 114 are determined so that the grayscale voltages $V_0$ to $V_{63}$ are regulated in accordance with the desired gamma curve. The number of the amplifiers 114 is also appropriately selected to achieve improved approximation of the desired gamma curve on the basis of the number of the grayscale voltages.

The grayscale voltage generator 110 is constantly activated during normal display operations. This results in that constant currents flow through the respective amplifiers 114 and the serially-connected resistors 15, undesirably increasing the power consumption of the grayscale voltage generator 110.

An explanation is made of the operation of the conventional LCD driver circuit with reference to FIG. 2. The conventional LCD driver circuit is designed to drive pixels in units of horizontal lines to display a desired image on the screen. A time period during which pixels associated with a horizontal line are driven is referred to as a horizontal period. The operation of the conventional LCD driver circuit during a horizontal period involves the amplifier driving, and the switch driving; as described above, the amplifier driving designates a drive method which drives drain lines to desired grayscale levels with amplifiers, and the switch driving designates a drive method which drives the drain lines by transferring the desired grayscale level received from the grayscale voltage generator 110 to the drain lines, as they are. In a typical drive operation, the conventional LCD driver circuit rapidly charges the drain line capacitances through the amplifier driving, and then drives the drain lines with the switch driving until the voltages across the LCD capacitances are stabilized.

FIG. 2 illustrates an exemplary operation timing of a drive circuitry relevant to driving one pixel. FIG. 2(*a*) illustrates a waveform of a horizontal sync signal H_sync, and FIG. 2(*b*) illustrates a waveform of a drive signal used for driving the switch 31*b*. FIG. 2(*c*) illustrates a waveform of a drive signal used for driving the switch 31*c*, and finally, FIG. 2(*d*) illustrates a waveform of the drive voltage SRC1. A horizontal period begins with activating the horizontal sync signal H_sync. In response to the activation of the horizontal sync signal H_sync, the drive circuit 31 is placed into a high impedance state until the drive signal for the switch 31*b* is activated. This period is referred to as the "Hi-Z period". In response to the activation of the drive signal, the switch 31*b* is turned on, and the turn-on of the switch 31*b* allows the amplifier 31*a* to output the drive signal SRC1 for driving the TFT panel 70. This results in that the drain line capacitance 75 and the LCD capacitance 73 are rapidly charged. Therefore, as shown in FIG. 2(*d*), the drive voltage SRC1 is rapidly pulled up. The period during which the drain line is driven by the amplifier 31*a* is referred to as the "amplifier driving period". After the drain line capacitance is charged by the amplifier 31*a*, the drive signal for driving the switch 31*b* is deactivated to turn off the switch 31*b*, and the drive signal for driving the switch 31*c* is activated to turn on the switch 31*c*. The tune-on of the switch 31*c* allows the drive circuit 31 to transmit the grayscale voltage inputted thereto as it is, to drive the LCD capacitance. This period is referred to as the "switch driving period", hereinafter. The present horizontal period completes when the horizontal sync signal is then activated. Pixels positioned on the next horizontal lines are then driven during the next horizontal period.

The voltage across the LCD capacitance 73 is stabilized by the end of the switch driving period, after the initiation of the amplifier driving. Therefore, the amplifier driving period and the switch driving period is collectively referred to as the LCD stabilizing period. The switch driving can be terminated with the TFT 71 tuned off after the stabilization of the voltage across the LCD capacitance 73 is achieved by the switch driving. In other words, stabilizing the voltage across the LCD capacitance 73 in a short duration of time allows shortening the duration of the LCD stabilizing period, and thereby effectively reduces the power consumption of the drive circuit 31.

Alternatively, the duration of one horizontal period may be increased with the duration of the LCD stabilizing period unchanged for reducing the power consumption. In other words, the frame frequency may be lowered to reduce the power consumption of the LCD driver. The operation current of the drive circuit 31 proportionally increases as the frame frequency increases. Therefore, reducing the frame frequency is expected to be effective for significantly reducing the power consumption. This approach is not effective when conventional drive methods are adopted, because the conventional drive methods experience poor image quality for frame frequency of 50 Hz or less; however, reducing the frame frequency is a promising approach, especially for the case that the dot inversion drive, which experiences reduced image degradation by flicker, is used, or for the case that the image quality degradation resulting from the reduced frame frequency is suppressed in the future by improving the performance of the LCD panel.

The power consumption reduction through lowering the frame frequency, which results in the reduction of the power consumption of the drive circuit 31, may be accompanied by switching the LCD drive method between the amplifier driving and the switching driving as described above. Additionally, such power consumption reduction approach may be also accompanied by an approach which involves incorporating series resistors for developing grayscale voltages within an output circuit and controlling input-side and output-side switches, as disclosed in Japanese Laid Open Patent Application No. Jp-A-Heisei, 7-325556.

Many of grayscale voltage generators (or gamma circuits) incorporate a reference voltage source for developing grayscale voltages. One issue of conventional gamma circuit controlling schemes is that a gamma circuit, incorporating a reference voltage source is continuously activated. This implies that a gamma circuit continuously consumes a constant power, independently of the frame frequency. Therefore, the ratio of power consumption of the grayscale voltage generator 110 to the total power consumption increases as the frame frequency decreases, because the power consumption of the drive circuit 31 decreases as the frame frequency decreases. In other words, lowering the frame frequency results in that the power consumption of the gamma circuit is relatively increased, the total power consumption of the chip mainly attributing the gamma circuit. For example, the ratio of the power consumption of the grayscale voltage generator 110 to the total power consumption of the LCD driver is 59.7% for a frame frequency of 30 Hz, and 74.4% for 15 Hz, while being 42.5% for a frame frequency of 60 Hz. Therefore, there is a need for reducing the power consumption of the grayscale voltage generator 110, especially when the frame frequency is reduced.

SUMMARY OF THE INVENTION

In an aspect of the present invention, a display panel driver is composed of a grayscale voltage generator configured to develop a set of different grayscale voltages corresponding to grayscale levels of pixels within a display panel; and a plurality of grayscale selector driver circuits each of which is responsive to pixel data to select one of the grayscale voltages, and to provide a drive voltage corresponding to the selected one of the grayscale voltages for a selected pixel within the display panel. The grayscale voltage generator is allowed to output the set of grayscale voltages during a first period within a horizontal period, and prohibited from outputting the set of grayscale voltages during a second period within the horizontal period.

Prohibiting grayscale voltage generator from outputting the grayscale voltages effectively reduces the power consumption of the grayscale voltage generator, and thereby effectively reduces the total power consumption.

BRIEF DESCRIPTION OF THE DRAWINGS

The above and other advantages and features of the present invention will be more apparent from the following description taken in conjunction with the accompanied drawings, in which.

DESCRIPTION OF THE PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

First Embodiment (LCD Driver Structure)

Figure 1A:
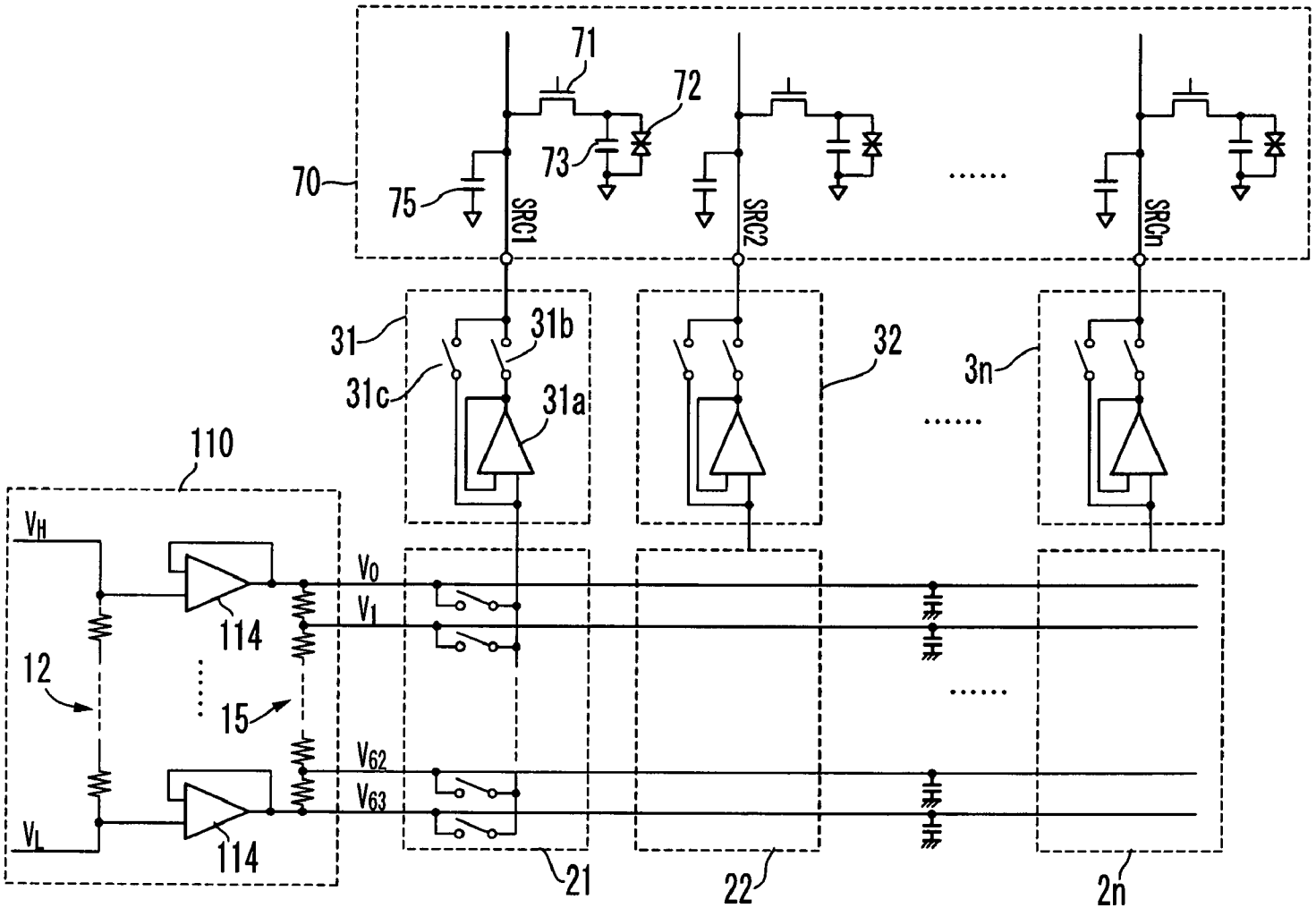
Fig. 1A PRIOR ART
FIG. 1A is a circuit diagram illustrating an exemplary structure of a conventional LCD driver.
Figure 1B:
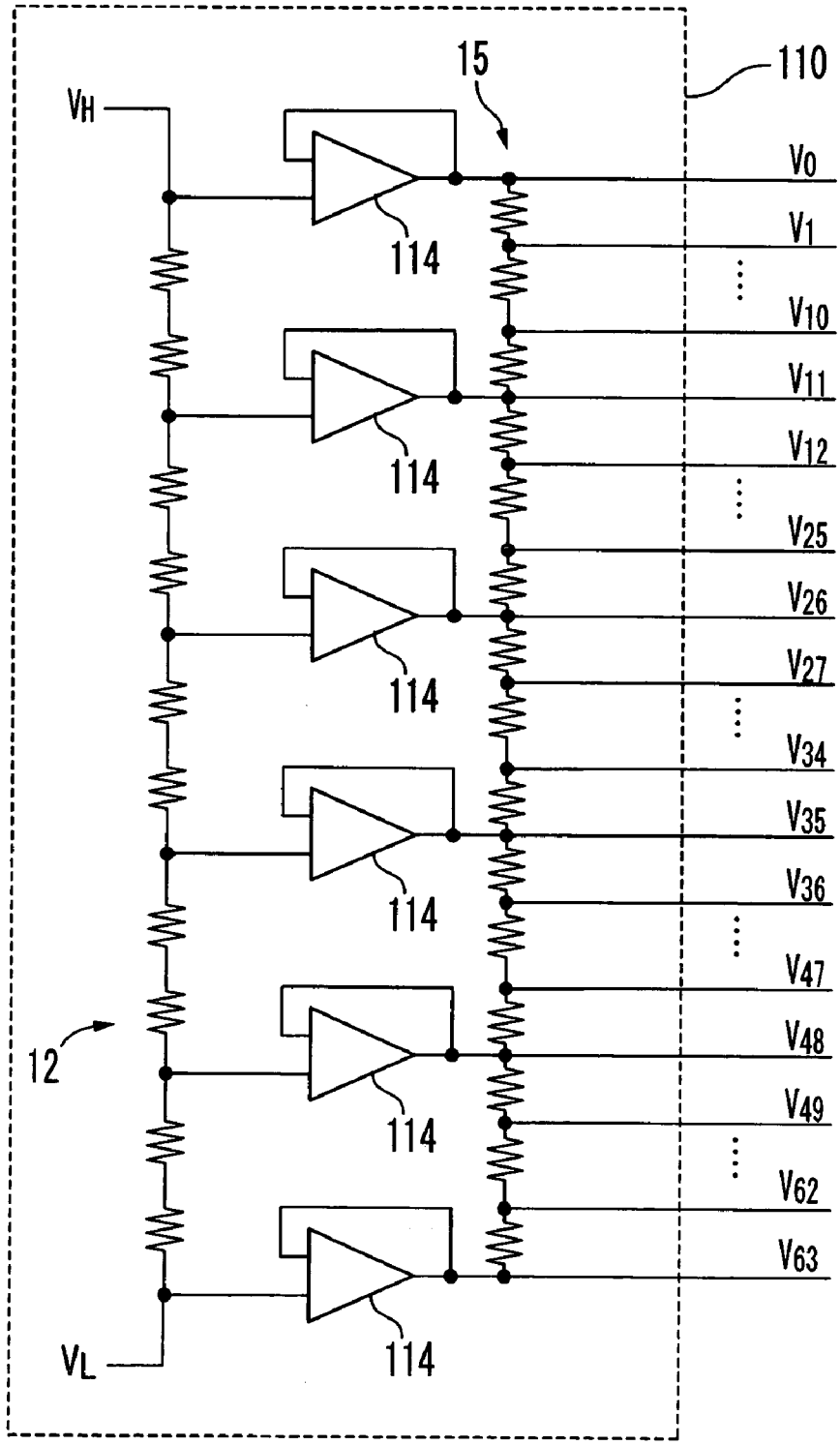
Fig. 1B PRIOR ART
FIG. 1B is a circuit diagram illustrating details of the structure of a grayscale voltage generator.
Figure 2:
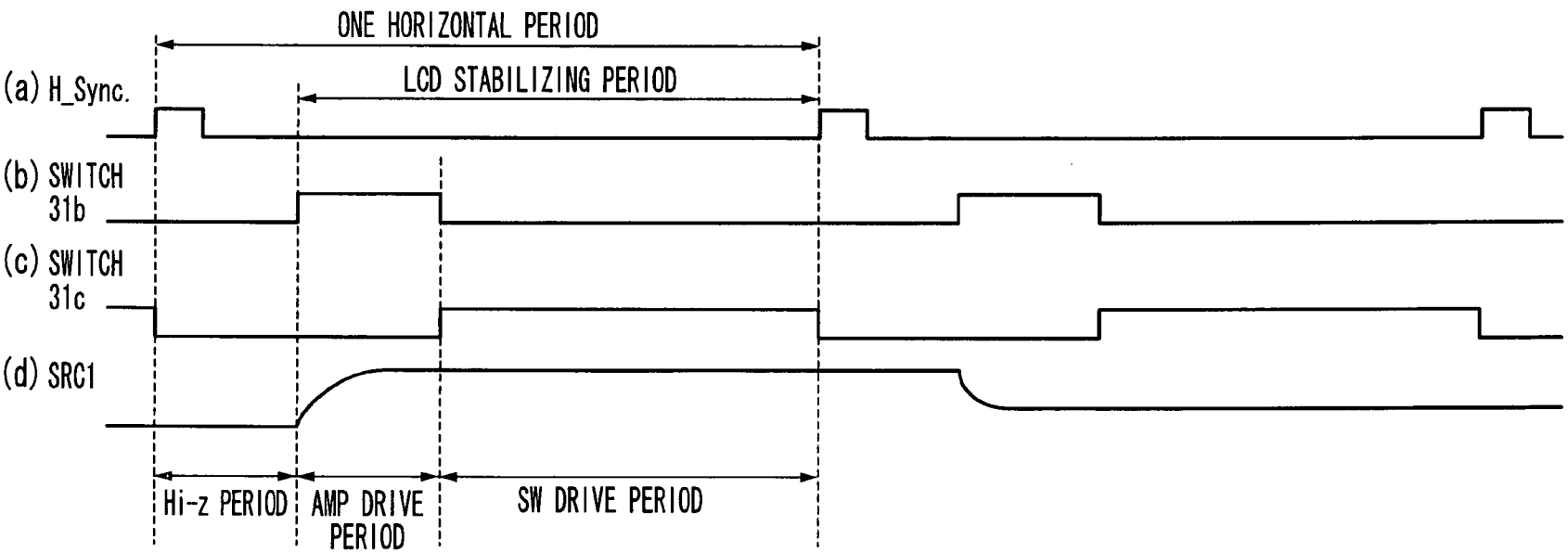
Fig. 2 PRIOR ART
FIG. 2 is a timing chart illustrating an exemplary operation of the convention LCD driver.
Figure 3:
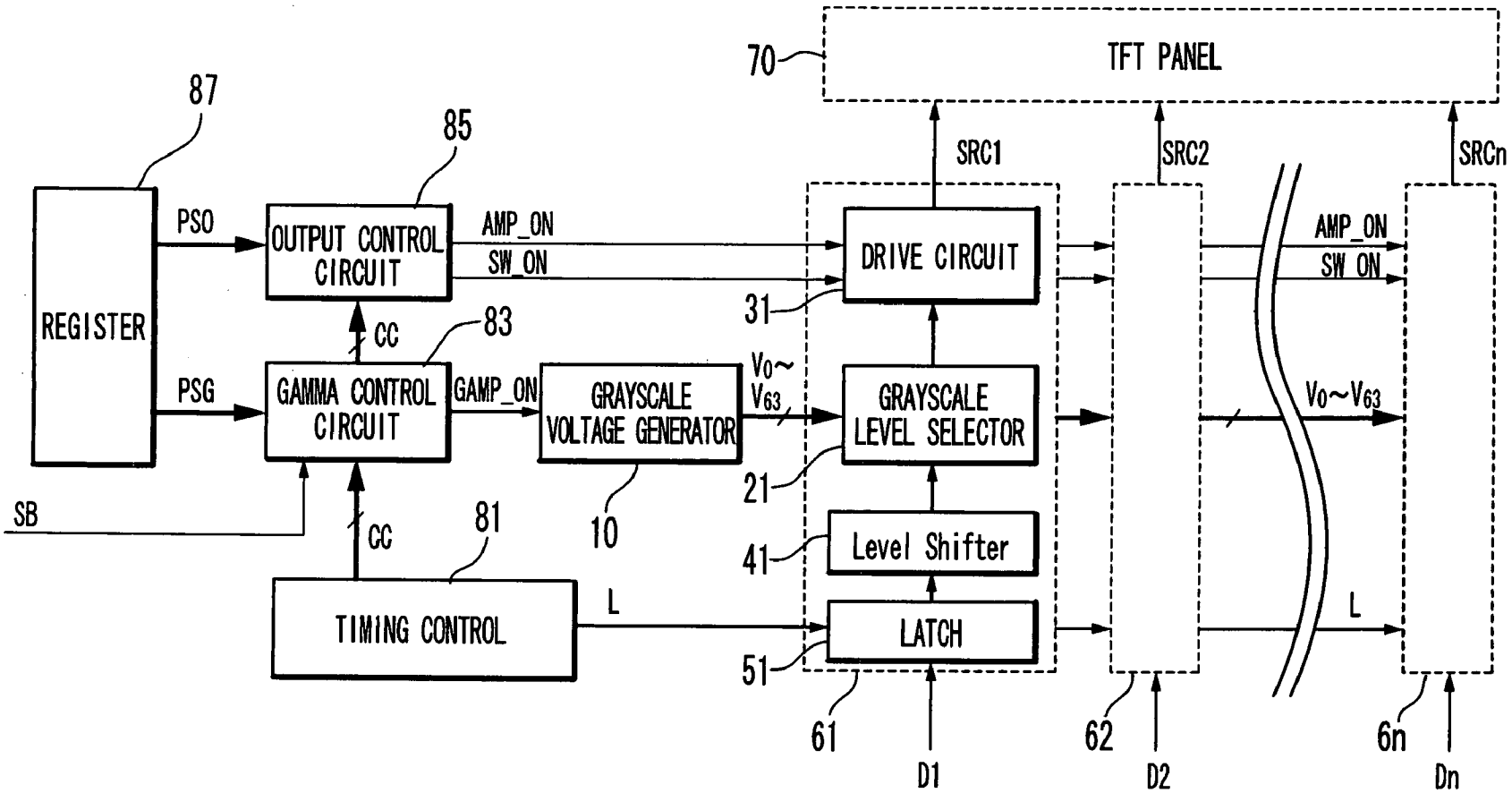
FIG. 3 is a block diagram illustrating an exemplary structure of an LCD driver in a first embodiment of the present invention.

FIG. 3 is a schematic block diagram of a LCD driver in a first embodiment. The LCD driver in this embodiment, which is designed to drive a TFT panel 70 of a liquid crystal display, is composed of a set of pixel drive circuitries 61, 62, . . . and 6*n*, a grayscale generator 10, a timing control circuit 81, a gamma control circuit 83, an output control circuit 85, and a register 87, wherein n is the number of pixels within the TFT panel 70 on each horizontal line.

The pixel driver circuitries 61, 62, . . . and 6*n* develop drive voltages SRC1, SRC2, . . . and SRCn, respectively, in response to pixel data D1, D2, . . . Dn received from an external circuit (not shown). The drive voltages SRC1, SRC2, . . . and SRCn are fed to the TFT panel 70. The pixel driver circuitries 61, 62, . . . and 6*n* are responsive to an amplifier drive signal AMP_ON and a switch drive signal SW_ON, which are received from the output control circuit 85. The pixel driver circuitries 61, 62, . . . and 6*n* uses the grayscale voltages $V_0$ to $V_{63}$ received from the grayscale voltage generator 10 to develops the drive voltages SRC1, SRC2, . . . and SRCn.

The grayscale voltage generator 10 is responsive to a gamma control signal GAMP_ON received from the gamma control signal 83. The gamma control circuit 83 and the output circuit 85 are responsive to timing control signals CC received from the timing control circuit 81. A standby signal SB is externally provided for the gamma control circuit 83. It should be noted that the standby signal SB is developed for suspending the system, and therefore, the standby signal SB is not synchronous with the initiation of horizontal periods.

The register 87 contains output control parameters PSO, and gamma control parameters PSG, which are used for determining timings of the signals outputted from the output control circuit 85 and the gamma control circuit 83. The output control parameters PSO include: an AMP_ON activation setting value indicative of activation timings of the amplifier drive signal AMP_ON; an AMP_ON deactivation setting value indicative of deactivation timings of the amplifier drive signal AMP_ON; an SW_ON activation setting value indicative of activation timings of the switch drive signal SW_ON; and an SW_ON deactivation setting value indicative of deactivation timings of the switch drive signal SW_ON. The output control parameters PSO are fed to the output control circuits 85 from the register 87.

The gamma control parameters PSG, on the other hand, includes: a GAMP_ON activation setting value indicative of activation timings of the gamma control signal GAMP_ON; and a GAMP_ON deactivation setting value indicative of deactivation timings of the gamma control signal GAMP_ON. The gamma control parameters PSG are fed to the gamma control circuit 83 from the register 87.

The timing control circuit 81 is responsive to an externally-provided horizontal sync signal and other control signals to develop a set of timing control signals CC and a latch timing signal L. The timing control signals CC include a clock signal and a clock count signal, which are synchronous with the pixel data and a scan signal. The timing control signals CC are fed to the gamma control circuit 83 and the output control circuit 85, and the latch timing signal L is fed to the pixel drive circuitries 61, 62, . . . and 6*n*.

The output control circuit 86 is responsive to the timing control signals CC received from the timing control circuit 81 and the output control parameters PSO received from the register 87 to develop the amplifier drive signal AMP_ON and the switch drive signal SW_ON. The amplifier drive signal AMP_ON is activated in response to the timing control signals CC at timings indicated by the AMP_ON activation setting value of the output control parameters PSO, and deactivated at timings indicated by the AMP_ON deactivation setting value. Correspondingly, the switch drive signal SW_ON is activated in response to the timing control signals CC at timings indicated by the SW_ON activation setting value of the output control parameters PSO, and deactivated at timings indicated by the SW_ON deactivation setting value. The amplifier drive signal AMP_ON and the switch drive signal SW_ON are fed to the pixel drive circuitries 61, 62, . . . and 6*n*.

The gamma control circuit 83 is responsive to the standby signal SB received externally, the timing control signals CC received from the timing control circuit 81, and the gamma control parameters PSG, to develop the gamma control signal GAMP_ON. The gamma control signal GAMP_ON is activated in response to the timing control signals CC at timings indicated by the GAMP_ON activation setting value of the gamma control parameters PSG, and deactivated at timings indicated by the GAMP_ON deactivation setting value. The gamma control signal GAMP_ON is fed to the pixel drive circuitries 61, 62, . . . and 6*n*.

It should be noted that conventional LCD drivers uses a standby signal which is activated in response to a system equipped with the LCD device being set standby. The standby state may be maintained for a long time. In a conventional system, a grayscale voltage generator is often suspended during standby in response to a standby signal to reduce the power consumption, because no image is displayed during standby. The LCD driver in this embodiment may use the standby signal SB to implement the present invention; the standby signal SB is used for suspending the grayscale voltage generator 10 during a portion of each horizontal period, and for thereby reducing the power consumption. This approach is economically effective, because no significant modification in the LCD driver architecture is required; this approach allows the LCD driver to implement the present invention only through modifying timing control of conventional LCD drivers.

The grayscale voltage generator 10 is responsive to the gamma control signal GAMP_ON received from the gamma control circuit 83 to develop the grayscale voltages $V_0$ to $V_{63}$. The grayscale voltages $V_0$ to $V_{63}$ are fed to the pixel drive circuitries 61, 62, . . . and 6*n*. The grayscale voltage generator 10 performs normal operation when the gamma control signal GAMP_ON is activated. When the gamma control signal GAMP_ON is deactivated, on the other hand, the grayscale voltage generator 10 is suspended to reduce power consumption.

The pixel drive circuitry 61 is composed of a latch circuit 51, a level shifter 41, a grayscale level selector 21, and a drive circuit 31. The latch circuit 51 latches externally-provided pixel data D1 associated with one pixel at a timing indicated by the latch timing signal L received from the timing control circuit 81. The level shifter 41 provides level shifting between the latch circuit 51 and the grayscale level selector 21 in transferring the pixel data D1 to the grayscale level selector 21. The level shifting allows the pixel data D1 to be used for driving switches within the grayscale level selector 21. The grayscale level selector 21 receives the grayscale voltages $V_0$ to $V_{63}$, and selects one associated with the pixel data D1 received from the latch circuit 51. The drive circuit 31 develops the drive voltage SRC1 having a level identical to that of the grayscale voltage selected by the grayscale level selector 21. The operation of the drive circuit 31 is responsive to the amplifier drive signal AMP_ON, and the switch drive signal SW_ON, which are received from the output control circuit 85. The other pixel drive circuitries 62, 63, . . . and 6*n* have the same structure as the pixel drive circuitries 61, and operate in the same way to develop the drive voltages SRC2, SRC3, and SRCn.

(Detail of LCD Driver Structure)

Figure 4:
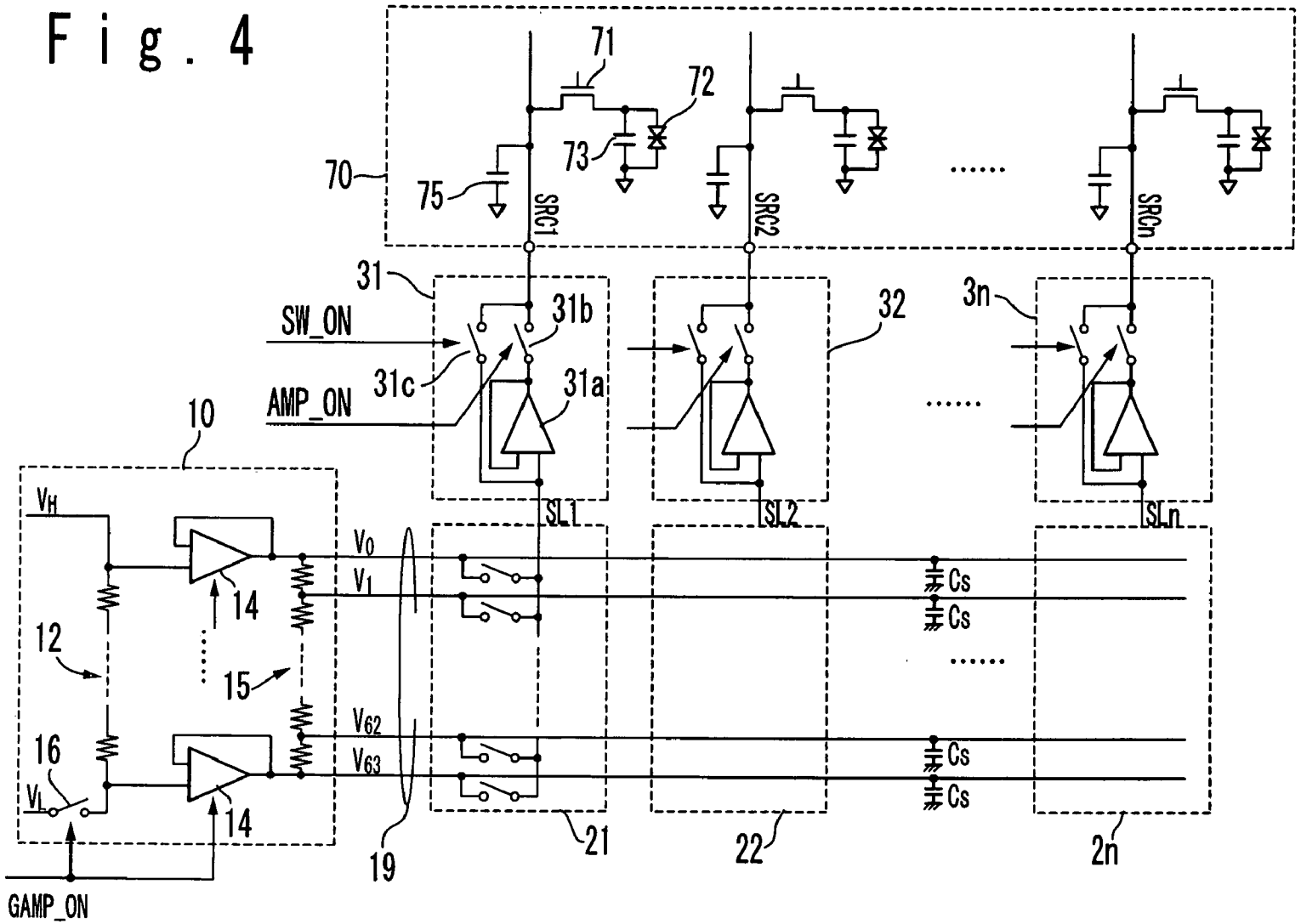
FIG. 4 is circuit diagram illustrating details of the structure of the LCD driver in the first embodiment.

FIG. 4 illustrates detailed structures of the LCD driver in this embodiment, especially depicting routes through which the grayscale voltages $V_0$ to $V_{63}$, generated by the grayscale voltage generator 10, are transferred to the TFT panel 70. The grayscale level selectors within the pixel drive circuitries 61, 62, and 6*n* are denoted by numerals 21, 22, . . . and 2*n*, respectively, and the drive circuits within the pixel drive circuitries 61, 62, . . . and 6*n* are denoted by numerals 31, 32, . . . and 3*n*, respectively.

The grayscale voltage generator 10 is composed of a set of serially-connected resistors 12, a set of amplifiers 14 (two shown), another set of serially connected resistors 15, and a switch 16. The serially-connected resistors 12 divide a power source voltage $V_H$-$V_L$ to develop a set of different voltages. The amplifiers 14 receive the set of different voltages, respectively, and develop a set of bias voltages through voltage follower operation in accordance with the received voltages on the associated nodes of the serially connected resistors 15. The serially connected resistors 15 receive the bias voltages on the nodes thereof, and develop grayscale voltages $V_0$ to $V_{63}$ through voltage dividing. The grayscale voltages $V_0$ to $V_{63}$ are fed to the grayscale level selectors 21, 22, . . . and 2*n* through a set of grayscale signal lines 19.

The switch 16 is turned on and off in response to the gamma control signal GAMP_ON to allow feeding the power source voltage $V_H$-$V_L$ to the serially-connected resistors 12. When the gamma control signal GAMP_ON is activated, the switch 16 is turned on to apply the power source voltage $V_H$-$V_L$ across the serially-connected resistors 12. When the gamma control signal GAMP_ON is deactivated, on the other hand, the switch 16 is turned off to stop feeding the power source voltage $V_H$-$V_L$ to the serially-connected resistors 12. The turn-off of the switch 16 terminates the current flow through the serially-connected resistors 12 to reduce the power consumption.

The amplifiers 14 are also controlled by the gamma control signal GAMP_ON. When the gamma control signal GAMP_ON is activated, the amplifiers 14 operate as buffers (or voltage followers) to provide bias voltages having the same levels as the associated voltages received from the serially-connected resistors 12. When the gamma control signal GAMP_ON is deactivated, on the other hand, the amplifiers 14 are placed into the high impedance state, that is, the outputs of the amplifiers 14 are set high-impedance (Hi-Z). This results in that the current flow through the serially-connected resistors 15 is stopped to reduce the power consumption.

The grayscale level selector 21 is composed of a set of switches selectable by the pixel data D1. One of the switches selected by pixel data D1 is turned on to transfer the associated one of the grayscale voltages $V_0$ to $V_{63}$ to the drive circuit 31. The grayscale voltage transferred to the drive circuit 31 is referred to as the selected grayscale voltage SL1. The grayscale level selectors 22, 23, . . . and 2*n* have the same structure, and operate in the same way.

The drive circuit 31 drives the associated pixel within the TFT panel 70 in response to the selected grayscale voltage SL1. The drive circuit 31 is composed of an amplifier 31*a*, a pair of switches 31*b* and 31*c*. The switch 31*b* is controlled by the amplifier drive signal AMP_ON received from the output control circuit 85. When the amplifier drive signal AMP_ON is activated, the switch 31*b* is turned on to connect the output of the amplifier 31*a* with the TFT panel 70. The switch 31*c* is controlled by the switch drive signal SW_ON received from the output control circuit 85. When the switch drive signal SW_ON is activated, the switch 31*c* is turned off to transfer the selected grayscale voltage SL1 therethrough to the TFT panel 70.

When the switch 31*b* is turned on and the switch 31*c* is turned off, the amplifier 31*a* rapidly drives the associated drain line within the TFT panel 70 to the voltage level identical to the selected grayscale voltage SL1, providing impedance transformation; this achieves the "amplifier driving" mentioned above. When the switch 31*b* is turned off and the switch 31*c* is turned on, the selected grayscale voltage SL1 is transferred to the associated drain line through the switch 31*c* to drive the LCD capacitance; this achieves the "switch driving". The drive circuit 32, 33, . . . and 3*n* have the same structure, and operate in the same way to drive the associated pixels.

The TFT panel 70 receives the drive voltages SRC1 to SRCn from the drive circuits 31 to 3*n*, respectively. The pixels on the selected horizontal line is driven with the drive voltages SRC1 to SRCn. Each pixel is composed of a TFT 71, a liquid crystal cell 72, and a LCD capacitance 73. Each drain line has a drain capacitance 75. When the drive voltage SRC1 is applied to the associated drain line with the TFT 71 selected, the drain capacitance 75 is charged or discharged, and the LCD capacitance 73 is also charged or discharged. After the voltage across the LCD capacitance 73 is stabilized, the TFT 71 is turned off. The LCD capacitance 73 maintains the voltage thereacross after the turn-off of the TFT 71. The liquid crystal cell 72 transfers light with a transmissivity depending on the voltage across the LCD capacitance 73.

It should be noted that the drive circuit 31 is not required to drive the selected pixel after the associated TFT 71 is turned off. This implies that the selected grayscale voltage SL1 is not required to be continuously fed to the selected cell, and the grayscale voltages $V_0$ to $V_{63}$, out of which the selected grayscale voltage SL1 is selected, are not required to be continuously fed to the grayscale level selector 21. The LCD drive in the first embodiment makes use of this fact for reducing the power consumption.

(Operation of LCD Driver)

An exemplary operation of the LCD driver in this embodiment is described below with reference to FIG. 5. The LCD driver drives pixels in units of horizontal lines to display a desired image on the screen. A time of period during which pixels on one horizontal line are driven is referred to as a horizontal period. The operation of the LCD drive during one horizontal period involves the "amplifier driving" and the "switch driving". The "amplifier driving" designates a driving method which drives drain lines to desired grayscale voltages with amplifiers, and the switch driving designates a drive method which drives the drain lines by transferring the desired grayscale level received from the grayscale voltage generator 10 to the drain lines. In conventional drive methods, the amplifier driving, which achieves rapid charge of the drain line capacitance, is followed by the switch driving to stabilize the voltage across the LCD capacitances.

In this embodiment, the switch driving is followed by suspending the operation of the grayscale voltage generator 10. This effectively reduces the power consumption of the LCD driver. Details of the operation of the LCD driver are given in the following.

Figure 5:
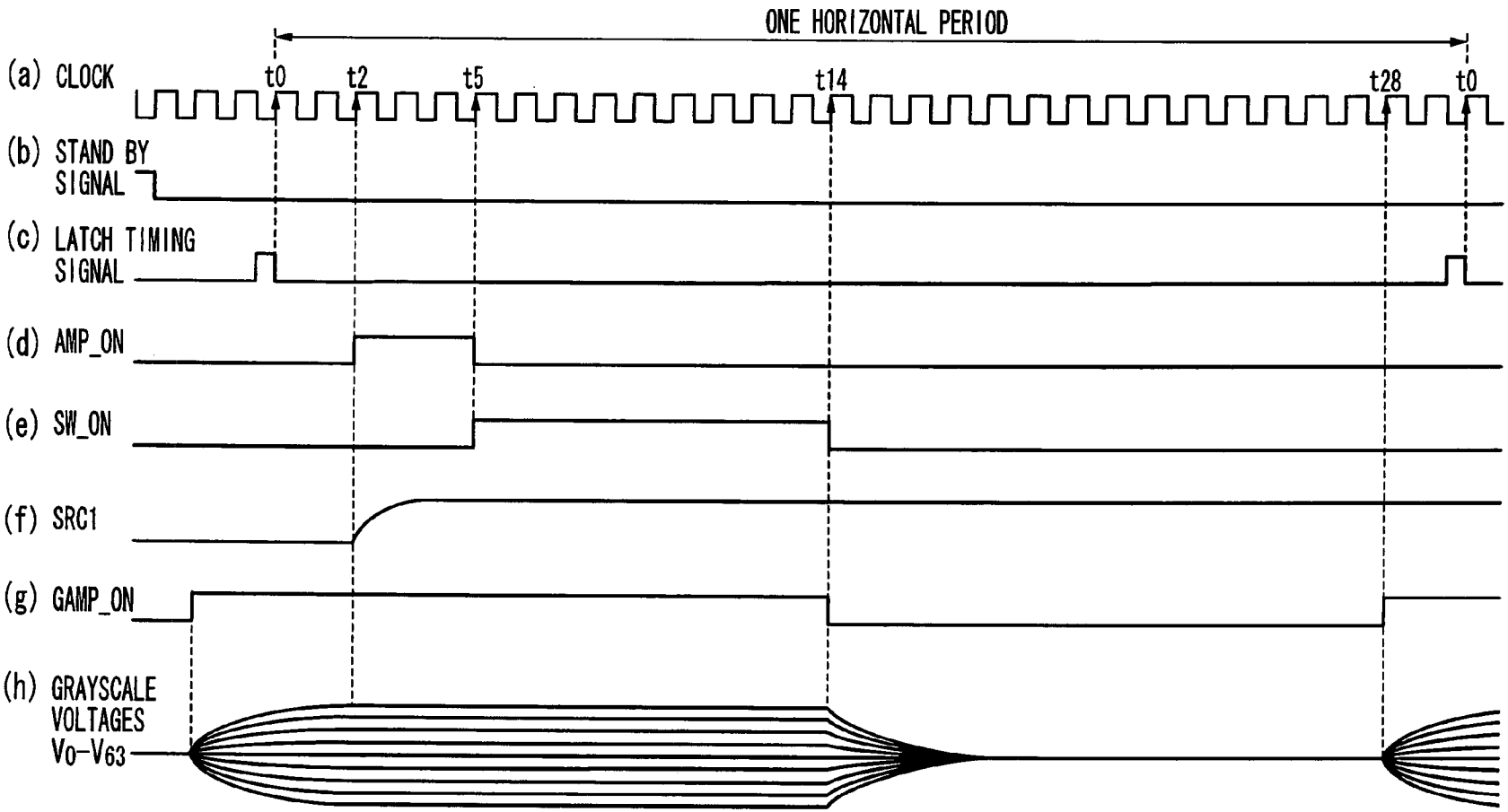
FIG. 5 is a timing chart illustrating an exemplary operation of the LCD driver in the first embodiment.

FIG. 5 illustrates operation timings of the grayscale voltage generator 10, the pixel drive circuitry 61; it should be noted that the pixel drive circuitries 62 to 6*n* operate in the same manner. FIG. 5(*a*) illustrates the waveform of the clock signal of the timing control signals CC developed by the timing control circuit 81, and FIG. 5(*b*) illustrates the waveform of the standby signal SB, which is externally provided. FIG. 5(*c*) illustrates the waveform of the latch timing signal L, which is developed by the timing control circuit 81, and FIG. 5(*d*) illustrates the waveform of the amplifier drive signal AMP_ON developed by the output control circuit 85. FIG. 5(*e*) illustrates the waveform of the switch drive signal SW_ON, and FIG. 5(*f*) is the waveform of the drive voltage SRC1 developed by the drive circuit 31. FIG. 5(*g*) illustrates the waveform of the gamma control signal GAMP_ON developed by the gamma control circuit 83. FIG. 5(*h*) illustrates the waveforms of the grayscale voltages $V_0$ to $V_{63}$, which are superposed in the same figure.

The amplifier drive signal AMP_ON is activated at a clock time t2 and deactivated at a clock time t5 by the output control circuit 85 in response to the basis of the AMP_ON activation setting value and the AMP_ON deactivation setting value stored in the register 87. The switch drive signal SW_ON is activated at the clock time t5 and deactivated at a clock time t14 by the output control circuit 85 in response to the SW_ON activation setting value and the SW_ON deactivation setting value stored in the register 87. The gamma control signal GAMP_ON is deactivated at the clock time t14 and activated at a clock time t28 by the gamma control circuit 83 in response to the GAMP_ON activation setting value and the GAMP_ON deactivation setting value stored in the register 87.

The LCD driver starts image display operation in response to the deactivation of the standby signal SB, which is externally provided. In this embodiment, one horizontal period initiates at a clock time t0, that is, at the timing just after the latch timing signal L is activated to latch the pixel data D1 into the latch circuit 51.

After the switches within the grayscale level selector 21 is selected by the pixel data and the selected grayscale voltage SL1 is stabilized, the amplifier drive signal AMP_ON is activated at the clock time t2. When the switch 31*b* is turned on in response to the activation of the amplifier drive signal AMP_ON, the amplifier 31*a* charges the drain line capacitance 75 and the LCD capacitance 73 within the associated pixel with the associated TFT 71 turned on. The drive voltage SRC1 is pulled up and finally stabilized to the selected grayscale voltage SL1 at a timing between the clock times t2 and t5.

At the clock time t5, the amplifier drive signal AMP_ON is deactivated to turn off the switch 31*b*, and the switch drive signal SW_ON is activated to turn on the switch 31*c*.

After the LCD capacitance 73 is fully charged, the TFT 71 is turned off. This eliminates the need for providing the grayscale voltages, because the voltage across the LCD capacitance 73 is sustained with the TFT 71 turned off. Accordingly, the switch drive signal SW_ON is then deactivated to turn off the switch 31*c* at the clock time t14. This is accompanied by deactivating the gamma control signal GAMP_ON to suspend the grayscale voltage generator 10. In response to the deactivation of the gamma control signal GAMP_ON, the switch 16 is turned off, and the amplifiers 14 are deactivated with the output thereof set high-impedance. This effectively reduces the current through the grayscale voltage generator 10, and thereby reduces the power consumption. It should be noted the timing of the deactivation of the switch drive signal SW_ON is not limited to be simultaneous with the timing of the deactivation of the gamma control signal GAMP_ON; the gamma control signal GAMP_ON may be deactivated after the deactivation of the switch drive signal SW_ON.

It should be noted that the voltage levels on the signal lines become equal after the outputs of the amplifiers 14 are set high-impedance, because the grayscale signal lines 19 between the grayscale voltage generator 10 and the grayscale level selector 21, 22, . . . and 2*n*, which are used to feed the grayscale voltages to the grayscale level selector 21, 22, . . . and 2*n*, are electrically connected with one another through the serially connected resistors 15. Placing the outputs of the amplifiers 14 into the high-impedance state allows electrical charges accumulated across the parasitic capacitances Cs of the grayscale signal lines 19 to be redistributed through the serially connected resistors 15. This results in that the voltages developed on the grayscale signal lines 19 are converged to a certain voltage level as shown in FIG. 5(*h*).

It takes a certain period of time to charge the parasitic capacitances of the grayscale signal lines 19 and to thereby drive the grayscale signal lines 19 to the desired grayscale voltages $V_0$ to $V_{63}$. Therefore, the gamma control signal GAMP_ON is activated sufficiently before the timing when the grayscale voltages $V_0$ to $V_{63}$ are required to be fed to the grayscale level generator 21, 22, . . . and 2*n* for the pixel drive operation during the next horizontal period. In FIG. 5, the clock time when the gamma control signal GAMP_ON is activated is denoted by the symbol t28. The activation of the gamma control signal GAMP_ON allows the grayscale voltage generator 10 to restart developing the grayscale voltages $V_0$ to $V_{63}$.

In summary, the architecture and operation of the LCD driver in this embodiment effectively reduce the power consumption of the grayscale voltage generator 10 through turning off the amplifiers 14 and the switch 16 in response to the gamma control signal GAMP_ON during a certain period of the horizontal period.

Second Embodiment

Figure 6:
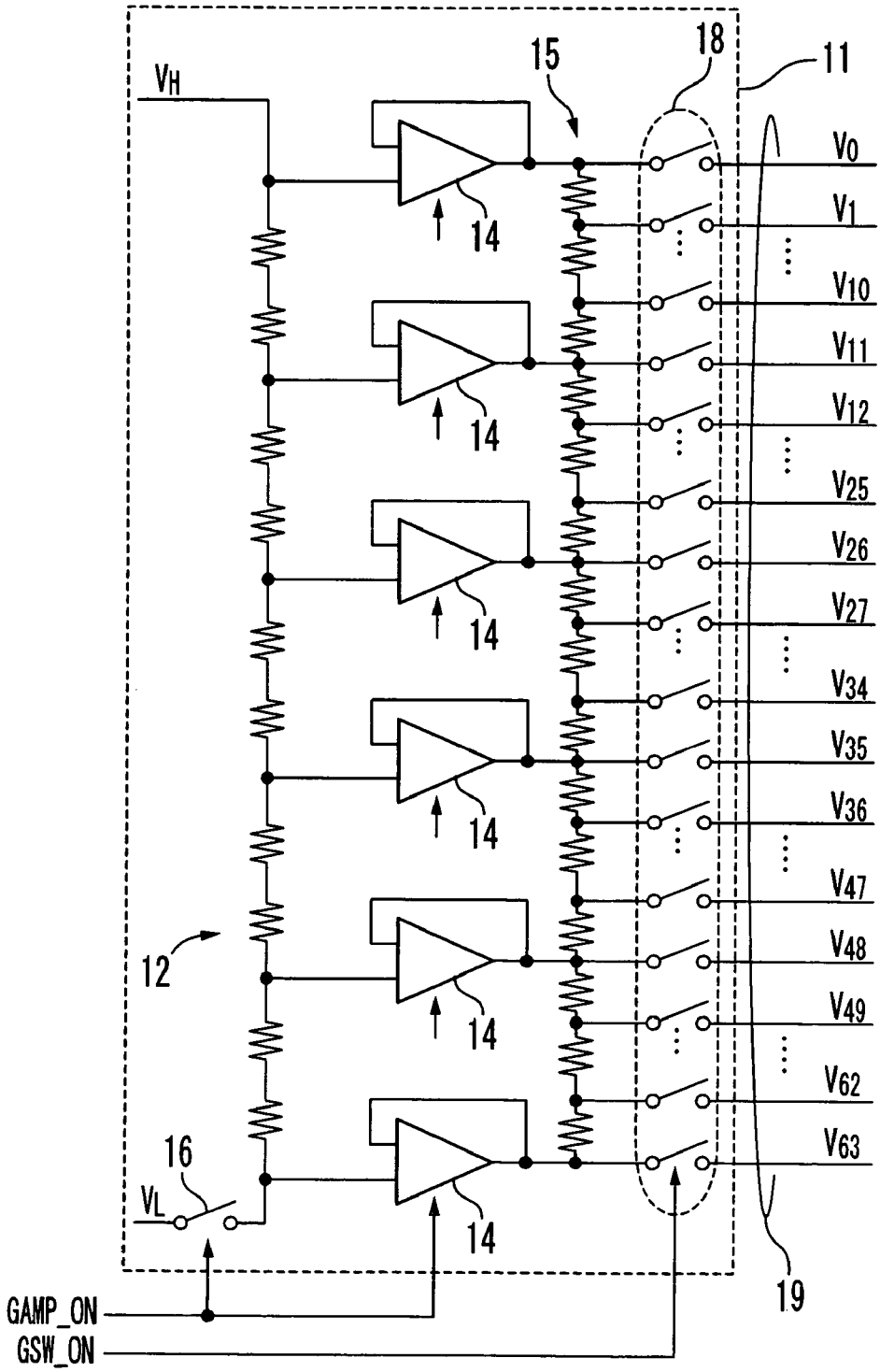
FIG. 6 is a circuit diagram illustrating an exemplary structure of a grayscale voltage generator in a second embodiment of the present invention.

FIG. 6 illustrates an exemplary structure of a grayscale voltage generator, denoted by the numeral 11, in a second embodiment. The structure of the grayscale voltage generator 11 addresses rapidly charging the parasitic capacitances of the grayscale signal lines 19 to the desired grayscale voltages $V_0$ to $V_{63}$, respectively. As described above, the LCD driver of the first embodiment suffers from a problem that it takes a considerable time to charge the parasitic capacitances of the grayscale signal lines 19 before the activation of the drive circuits 31 (that is, before the turn-on of the amplifier 31*a*), because the charges accumulated across the parasitic capacitances Cs of the grayscale signal lines 19 are redistributed through the serially-connected resistors 15. The structure of the grayscale voltage generator 11 in this embodiment effectively avoids the redistribution of the charges accumulated across the parasitic capacitances Cs of the grayscale signal lines 19 to addresses solving this problem.

As shown in FIG. 6, the structure of the grayscale voltage generator 11 is different from that of the grayscale voltage generator 10 shown in FIG. 4 in that the grayscale voltage generator 11 additionally includes a set of switches disposed between the serially-connected resistors 15 and the grayscale level selectors 21, 22, . . . and 2*n*.

More specifically, the grayscale voltage generator 11 is composed of a set of serially-connected resistors 12, a set of amplifiers 14, another set of serially connected resistors 15, a switch 16 connected to the serially-connected resistors 12, and a set of switches 18 connected between the serially-connected resistors and the grayscale signal lines 19.

The serially-connected resistors 12 divide a power source voltage $V_H$-$V_L$ to develop a set of different voltages. The amplifiers 14 receive the set of different voltages, respectively, and develop a set of bias voltages through voltage follower operation in accordance with the received voltages on the associated nodes of the serially connected resistors 15. The serially connected resistors 15 receive the bias voltages on the nodes thereof, and develop grayscale voltages $V_0$ to $V_{63}$ through voltage dividing. The grayscale voltages $V_0$ to $V_{63}$ are fed to the grayscale signal lines 19 through the switches 18.

The switch 16 is turned on and off in response to the gamma control signal GAMP_ON to allow feeding the power source voltage $V_H$-$V_L$ to the serially-connected resistors 12. When the gamma control signal GAMP_ON is activated, the switch 16 is turned on to apply the power source voltage $V_H$-$V_L$ across the serially-connected resistors 12. When the gamma control signal GAMP_ON is deactivated, on the other hand, the switch 16 is turned off to stop feeding the power source voltage $V_H$-$V_L$ to the serially-connected resistors 12. The turn-off of the switch 16 terminates the current flow through the serially-connected resistors 12 to reduce the power consumption.

The amplifiers 14 are also controlled by the gamma control signal GAMP_ON. When the gamma control signal GAMP_ON is activated, the amplifiers 14 operate as buffers (or voltage followers) to provide bias voltages having the same levels as the associated voltages received from the serially-connected resistors 12. When the gamma control signal GAMP_ON is deactivated, on the other hand, the amplifiers 14 are placed into the high impedance state, that is, the outputs of the amplifiers 14 are set high-impedance (Hi-Z). This results in that the current flow through the serially-connected resistors 15 is stopped to reduce the power consumption.

The switches 18 are turned on and off in response to a gamma switch control signal GSW_ON received from the gamma control circuit 83. When the gamma switch control signal GSW_ON is activated, the switches 18 are turned on to transfer the grayscale voltage $V_0$ to $V_{63}$ developed by the serially-connected resistors 15 to the grayscale signal lines 19. When the gamma switch control signal GSW_ON is deactivated, on the other hand, the switches 18 are turned off to electrically isolate the grayscale signal lines 19 from the serially-connected resistors 15. This allows the individual grayscale signal lines 19 are electrically isolated from one another to avoid the redistribution of the charges accumulated across the parasitic capacitances Cs of the grayscale signal lines 19. This allows maintaining the voltage levels on the grayscale signal lines 19.

The use of the grayscale voltage generator 11 within the LCD driver instead of the grayscale voltage generator 11 shown in FIGS. 3 and 4 is accompanied by minor changes in the operations of the gamma control circuit 83 and the register 87. The gamma control circuit 83 is modified to additionally develop the gamma switch control signal GSW_ON for controlling the switches 18. The register 87 contains additional parameters for controlling the generation of the gamma switch control signal GSW_ON by the gamma control circuit 83, and the additional parameters are added to the gamma control parameter PSG fed to the gamma control circuit 83.

Such LCD driver architecture effectively reduces the duration necessary for charging the parasitic capacitances of the grayscale signal lines 19, and thereby allows the grayscale voltage generator 11 to be deactivated for a longer time. This is advantageous for further reducing the power consumption of the LCD driver.

Figure 7:
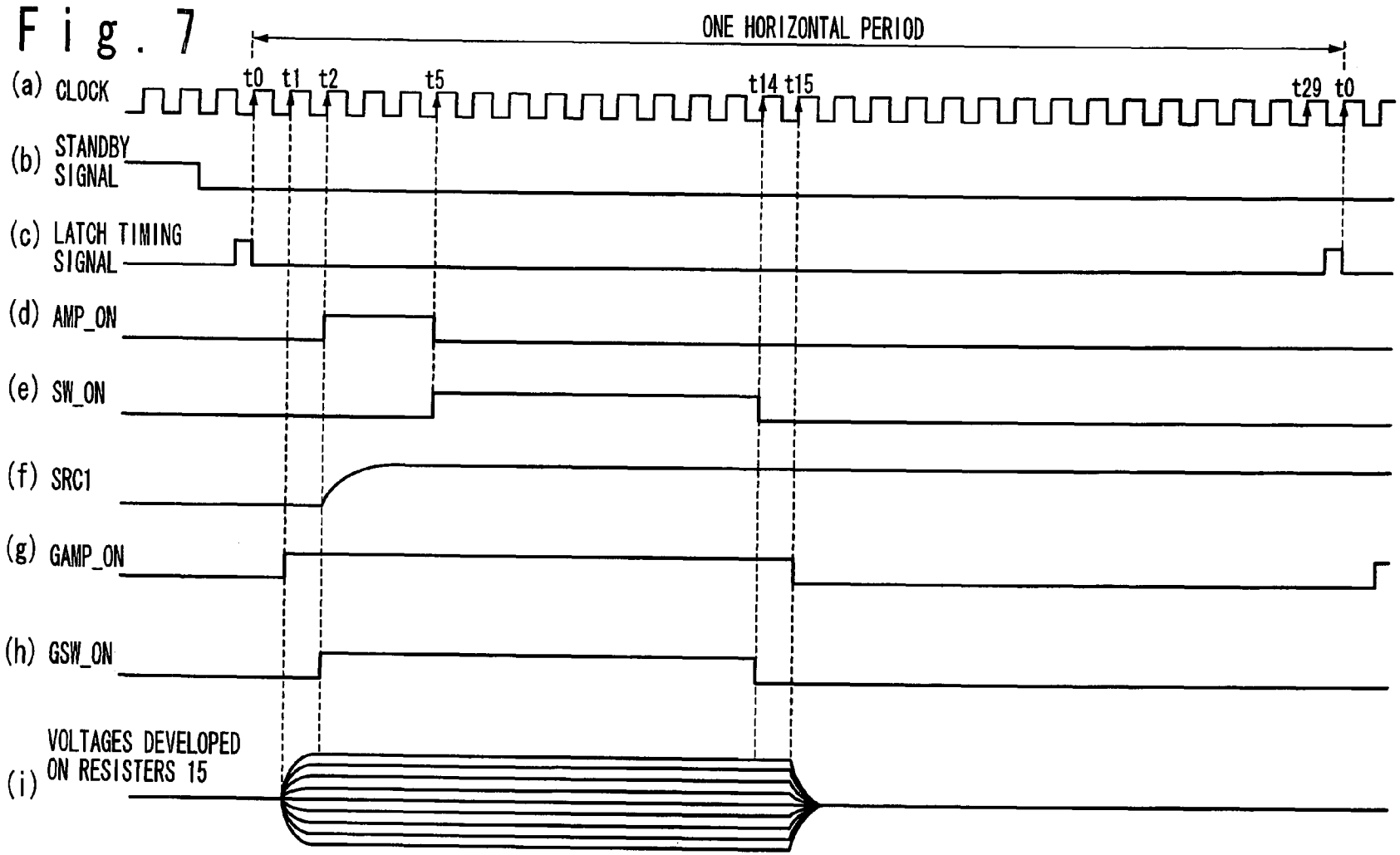
FIG. 7 is a timing chart illustrating an exemplary operation of the LCD driver in the second embodiment.

FIG. 7 is a timing chart illustrating an exemplary operation of the LCD driver in this embodiment, which incorporates the grayscale voltage generator 11, especially illustrating the operations of the grayscale voltage generator 11, and the pixel drive circuitries 61; it should be noted that the pixel drive circuitries 62 to 6*n* operate in the same manner. FIG. 7(*a*) illustrates the waveform of the clock signal of the timing control signals CC developed by the timing control circuit 81, and FIG. 7(*b*) illustrates the waveform of the standby signal SB, which is externally provided. FIG. 7(*c*) illustrates the waveform of the latch timing signal L, which is developed by the timing control circuit 81, and FIG. 7(*d*) illustrates the waveform of the amplifier drive signal AMP_ON developed by the output control circuit 85. FIG. 7(*e*) illustrates the waveform of the switch drive signal SW_ON, and FIG. 7(*f*) is the waveform of the drive voltage SRC1 developed by the drive circuit 31. FIG. 7(*g*) illustrates the waveform of the gamma control signal GAMP_ON developed by the gamma control circuit 83. FIG. 7(*h*) illustrates the waveform of the gamma switch control signal GSW_ON developed by the gamma control circuit 83. Finally, FIG. 7(*i*) illustrates the waveforms of the voltage levels on the respective nodes of the serially-connected resistors 15, which are superposed in the same figure.

The LCD driver starts image display operation in response to the deactivation of the standby signal SB, which is externally provided. In this embodiment, one horizontal period initiates at a clock time t0, that is, at the timing just after the latch timing signal L is activated to latch the pixel data D1 into the latch circuit 51.

The gamma control signal GAMP_ON is activated by the gamma control circuit 83 at a clock time t1 in response to the GAMP_ON activation setting value stored in the register 87. The timing of the activation of the gamma control signal GAMP_ON is determined so that the grayscale voltages $V_0$ to $V_{63}$ are stably developed on the nodes of the serially-connected resistors 15 before the initiation of the "amplifier driving" in response to the activation of the amplifier drive signal AMP_ON. The activation of the gamma control signal GAMP_ON allows the amplifiers 14 to be activated, and the nodes of the serially-connected resistors 15 are driven to the desired grayscale voltages $V_0$ to $V_{63}$.

At a clock time t2, when the grayscale voltages $V_0$ to $V_{63}$ are stably developed on the nodes of the serially-connected resistors 15, the gamma control circuit 83 activates the gamma switch control signal GSW_ON in response to a GSW_ON activation setting value stored in the register 87. In response to the activation of the gamma switch control signal GSW_ON, the switches 18 are turned on, and the grayscale voltage generator 11 starts outputting the grayscale voltages $V_0$ to $V_{63}$ on the grayscale signal lines 19. In the meanwhile, the switches within the grayscale level selector 21 are selected in response to the pixel data D1 latched by the latch circuit 51. Selected one of the grayscale voltages $V_0$ to $V_{63}$, which is referred to as the selected grayscale voltage SL1, is fed to the drive circuit 31 from the grayscale level selector 21.

At the clock time t2, the amplifier drive signal AMP_ON is additionally activated by the output control circuit 85 in response to the AMP_ON activation setting value stored in the register 87. In response to the activation of the amplifier drive signal AMP_ON, the switch 31*b* is turned on to connect the output of the amplifier 31*a* with the associated drain line within the TFT panel 70. The amplifier 31*a* develops the drive voltage SRC1 corresponding to the selected grayscale voltage SL1 to charge the drain line capacitance 75 and the LCD capacitance 73 within the associated pixel with the associated TFT 71 turned on. The drive voltage SRC1 is pulled up and stabilized to the selected grayscale voltage SL1.

At the clock time t5, the amplifier drive signal AMP_ON is deactivated to turn off the switch 31*b*, and the switch drive signal SW_ON is activated to turn on the switch 31*c*. This allows the LCD driver to switch the drive operation from the amplifier driving to the switch driving.

After the LCD capacitance 73 is fully charged, the TFT 71 is turned off. The switch drive signal SW_ON is then deactivated to turn off the switch 31*c* at the clock time t14.

Simultaneously with, or slightly after the deactivation of the switch drive signal SW_ON, the gamma switch control signal GSW_ON is deactivated by the gamma control circuit 83 in response to a GSW_ON deactivation setting value stored in the register 87. In response to the deactivation of the gamma switch control signal GSW_ON, the switches 18 are turned off to electrically isolate the grayscale signal lines 19 from the serially-connected resisters 15.

At a clock time t15, after the grayscale signal lines 19 are disconnected from the serially-connected resisters 15, the gamma control signal GAMP_ON is deactivated by the gamma control circuit 83 in response to the GAMP_ON deactivation setting value stored in the register 87. The deactivation of the gamma control signal GAMP_ON allows the grayscale voltage generator 10 to be suspended. Specifically, in response to the deactivation of the gamma control signal GAMP_ON, the switch 16 is turned off, and the amplifiers 14 are deactivated with the output thereof set high-impedance. This effectively reduces the current through the grayscale voltage generator 11, and thereby reduces the power consumption.

The electrical isolation of the grayscale signal lines 19 from the serially-connected resisters 15 effectively avoids the charge redistribution among the grayscale signal lines 19 through the serially-connected resisters 15 after the deactivation of the amplifiers 14. The electrical isolation of the grayscale signal lines 19 from the serially-connected resisters 15 effectively maintains the voltage levels on the grayscale signal lines 19, and eliminates the need for driving the grayscale signal lines 19 to the grayscale voltages $V_0$ to $V_{63}$. This effectively reduces the duration during which the grayscale voltage generator 11 is required to develop the grayscale voltages $V_0$ to $V_{63}$, and thereby reduces the power consumption of the grayscale voltage generator 11.

The grayscale voltage generator 11 is kept suspended until a clock time t1 of the next horizontal period. In other words, the suspend period of the grayscale voltage generator 11 begins at the clock time t15 at the present horizontal period, and ends at the clock time t1 of the next horizontal period. In this embodiment, the suspend period of the grayscale voltage generator 11 lasts for 16 clock cycles for each horizontal period, while the suspend period of the grayscale voltage generator 10 lasts for 14 clock cycles in the first embodiment. This implies that the LCD driver architecture in the second embodiment effectively reduces the duration during which the grayscale voltage generator 11 is required to develop the grayscale voltages $V_0$ to $V_{63}$. It should be noted that the suspend period may be modified on the basis of the parasitic capacitances Cs and the resistances of the grayscale signal lines 19, and the resistance values of the serially-connected resistors 15, and so forth.

As mentioned above, the LCD driver in the second embodiment is designed to electrically isolate the grayscale signal lines 19 from the serially-connected resistors 15 by the switches 18, and to thereby avoid the redistribution of the electric charges among the grayscale signal lines 19. This is advantageous for reducing the power consumption of the grayscale voltage generator 11.

Third Embodiment

Figure 8:
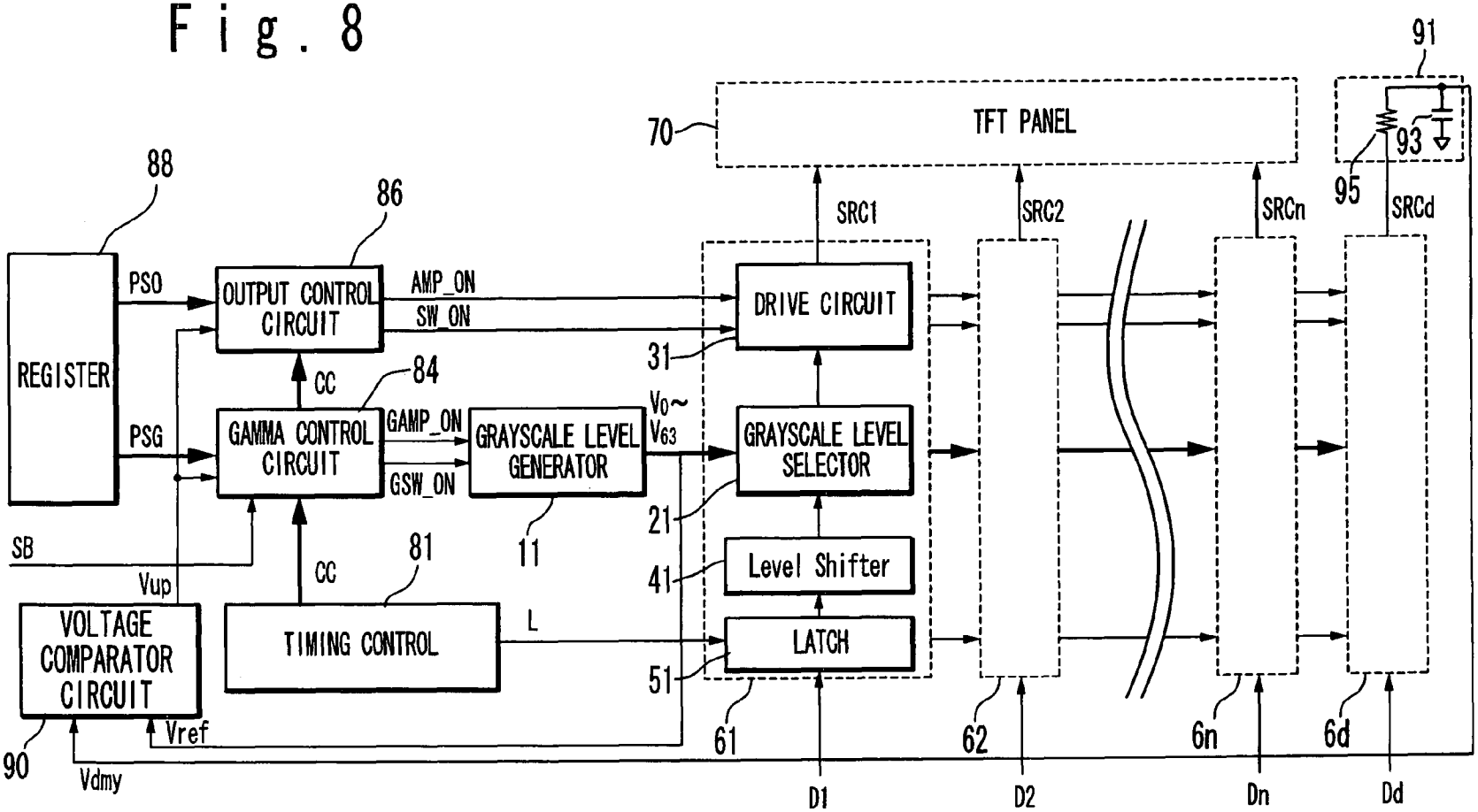
FIG. 8 is a block diagram illustrating an exemplary structure of an LCD driver in a third embodiment of the present invention.

FIG. 8 illustrates an exemplary structure of an LCD driver in a third embodiment of the present invention. The structure of the LCD driver in this embodiment is almost similar to that in the second embodiment. One feature of the LCD driver in this embodiment is that the LCD driver additionally includes a dummy load circuit, which is denoted by numeral 91 in FIG. 8, which simulates the electrical characteristics of the TFT panel 70. The dummy load circuit is used for dynamically determining the following timings: a timing when the switch driving is terminated, a timing when the switches 18 are turned off, and a timing when the grayscale voltage generator 11 is deactivated.

More specifically, the LCD driver in this embodiment, which is designed to drive a TFT panel 70 of a liquid crystal display, is composed of a set of pixel drive circuitries 61, 62, . . . and 6*n*, a grayscale generator 11, a timing control circuit 81, a gamma control circuit 84, an output control circuit 86, and a register 88, wherein n is the number of pixels within the TFT panel 70 on each horizontal line. The LCD driver in this embodiment additionally includes a dummy load circuit 91, a pixel drive circuitry 6*d*, and a voltage comparator 90.

The pixel driver circuitries 61, 62, . . . and 6*n* develop drive voltages SRC1, SRC2, . . . and SRCn, respectively, in response to pixel data D1, D2, . . . Dn received from an external circuit (not shown). Correspondingly, the pixel drive circuitry 6*d*, associated with the dummy load circuit 91, develops a drive voltage SRCd in response to pixel data Dd. The pixel data Dd is not used for displaying an image, and therefore, the value of the pixel data Dd may be predetermined. The drive voltages SRC1, SRC2, . . . and SRCn, developed by the pixel drive circuitries 61, 62, . . . and 6*n* are fed to the TFT panel 70, while the drive voltage SRCd developed by the pixel drive circuitry 6*d* is fed to the dummy load circuit 91. The pixel driver circuitries 61, 62, . . . 6*n*, and 6*d* are responsive to an amplifier drive signal AMP_ON and a switch drive signal SW_ON, which are received from the output control circuit 86. The pixel driver circuitries 61, 62, . . . 6*n*, and 6*d* uses the grayscale voltages $V_0$ to $V_{63}$ received from the grayscale voltage generator 11 to develops the drive voltages SRC1, SRC2, . . . SRCn, and SRCd.

The grayscale voltage generator 11 is responsive to a gamma control signal GAMP_ON received from the gamma control signal 84. The gamma control circuit 84 and the output circuit 86 are responsive to timing control signals CC received from the timing control circuit 81. A standby signal SB is externally provided for the gamma control circuit 84.

The voltage comparator 90 is responsive to an output measured voltage Vdmy received from the dummy load circuit 91 to develop a comparison result signal Vup. One or more of the grayscale voltages received from the grayscale voltage generator 11 are used to develop a reference voltage within the voltage comparator 90. The comparison result signal Vup is provided for the gamma control circuit 84 and the output control circuit 86.

The register 88 contains the output control parameters PSO, and the gamma control parameters PSG, which are used for determining timings of the signals outputted from the output control circuit 86 and the gamma control circuit 84. The output control parameters PSO include: an AMP_ON activation setting value indicative of activation timings of the amplifier drive signal AMP_ON; an AMP_ON deactivation setting value indicative of deactivation timings of the amplifier drive signal AMP_ON; an SW_ON activation setting value indicative of activation timings of the switch drive signal SW_ON; and an SW_ON extra clock cycle setting value (Csw) indicative of deactivation timings of the switch drive signal SW_ON. The output control parameters PSO are fed to the output control circuits 86 from the register 88.

The gamma control parameters PSG, on the other hand, includes: a GAMP_ON activation setting value indicative of activation timings of the gamma control signal GAMP_ON; a GAMP_ON extra clock cycle setting value (Cgamp) indicative of deactivation timings of the gamma control signal GAMP_ON, a GSW_ON activation setting value indicative of activation timings of the gamma switch control signal GSW_ON; and a GSW_ON extra clock cycle setting value (Cgsw) indicative of deactivation timings of the gamma switch control signal GSW_ON. The gamma control parameters PSG are fed to the gamma control circuit 84 from the register 88.

The timing control circuit 81 is responsive to an externally-provided horizontal sync signal and other control signals to develop a set of timing control signals CC and a latch timing signal L. The timing control signals CC include a clock signal and a clock count signal, which are synchronous with the pixel data and a scan signal. The timing control signals CC are fed to the gamma control circuit 84 and the output control circuit 86, and the latch timing signal L is fed to the pixel drive circuitries 61, 62, . . . and **6*n***.

The output control circuit 86 is responsive to the timing control signals CC received from the timing control circuit 81 and the output control parameters PSO received from the register 88 to develop the amplifier drive signal AMP_ON and the switch drive signal SW_ON. The amplifier drive signal AMP_ON is activated in response to the timing control signals CC at timings indicated by the AMP_ON activation setting value of the output control parameters PSO, and deactivated at timings indicated by the AMP_ON deactivation setting value. Correspondingly, the switch drive signal SW_ON is activated in response to the timing control signals CC at timings indicated by the SW_ON activation setting value of the output control parameters PSO, and deactivated at timings indicated by the SW_ON extra clock cycle setting value (Csw). The amplifier drive signal AMP_ON and the switch drive signal SW_ON are fed to the pixel drive circuitries 61, 62, . . . and **6*n***.

The gamma control circuit 84 is responsive to the standby signal SB received externally, the timing control signals CC received from the timing control circuit 81, and the gamma control parameters PSG, to develop the gamma control signal GAMP_ON and the gamma switch control signal GSW_ON. The gamma control signal GAMP_ON is activated in response to the timing control signals CC at timings indicated by the GAMP_ON activation setting value of the gamma control parameters PSG, and deactivated at timings indicated by the GAMP_ON extra clock cycle setting value (Cgamp). The gamma control signal GAMP_ON is fed to the pixel drive circuitries 61, 62, . . . and **6*n*. Correspondingly, the gamma switch control signal GSW_ON is activated in response to the timing control signals CC at timings indicated by the GSW_ON activation setting value of the gamma control parameters PSG, and deactivated at timings indicated by the GSW_ON extra clock cycle setting value (Cgsw). The gamma switch control signal GSW_ON is fed to the pixel drive circuitries 61, 62, . . . and 6*n***.

The grayscale voltage generator 11 is responsive to the gamma control signal GAMP_ON and the gamma switch control signal GSW_ON, which are received from the gamma control circuit 83, to develop the grayscale voltages $V_0$ to $V_{63}$. The grayscale voltages $V_0$ to $V_{63}$ are fed to the pixel drive circuitries 61, 62, **6*n*, and 6*d*. The grayscale voltage generator 11 performs normal operation when the gamma control signal GAMP_ON is activated. When the gamma control signal GAMP_ON is deactivated, on the other hand, the grayscale voltage generator 11 is suspended to reduce power consumption. The switches 18 within the grayscale voltage generator 11 are responsive to the gamma switch control signal GSW_ON (see FIG. 6). When the gamma switch control signal GSW_ON is activated, the switches 18 are turned on to transfer the grayscale voltages $V_0$ to $V_{63}$ to the drive circuitries 61, 62, . . . 6*n* and 6*d* through the grayscale signal lines 19. When the gamma switch control signal GSW_ON is deactivated, on the other hand, the switches 18 are turned off to disconnect the grayscale signal lines 19 from the serially-connected resistors 15**.

The pixel drive circuitry 61 is composed of a latch circuit 51, a level shifter 41, a grayscale level selector 21, and a drive circuit 31. The latch circuit 51 latches externally-provided pixel data D1 associated with one pixel at a timing indicated by the latch timing signal L received from the timing control circuit 81. The level shifter 41 provides level shifting between the latch circuit 51 and the grayscale level selector 21 in transferring the pixel data D1 to the grayscale level selector 21. The level shifting allows the pixel data D1 to be used for driving switches within the grayscale level selector 21. The grayscale level selector 21 receives the grayscale voltages $V_0$ to $V_{63}$, and selects one associated with the pixel data D1 received from the latch circuit 51. The drive circuit 31 develops the drive voltage SRC1 having a level identical to that of the grayscale voltage selected by the grayscale level selector 21. The operation of the drive circuit 31 is responsive to the amplifier drive signal AMP_ON, and the switch drive signal SW_ON, which are received from the output control circuit 86. The other pixel drive circuitries 62, 63, . . . **6*n* and 6*d* have the same structure as the pixel drive circuitries 61, and operate in the same way to develop the drive voltages SRC2, SRC3**, . . . SRCn, and SRCd.

The dummy load circuit 91 is designed to simulate electrical characteristics of one pixel and one drain line within the TFT panel 70. In this embodiment, each pixel is represented as a capacitive load, and therefore, the dummy load circuit 91 is composed of a capacitor 93 and a resistor 95 which are serially connected. The drive voltage SRCd is fed to one terminal of the resistor 95, and the other terminal thereof is connected to one terminal of the capacitor 93. The other terminal of the capacitor 93 is connected to a common electrode. The output of the dummy load circuit 91 is the voltage across the capacitor 93, which is referred to as the output measured voltage Vdmy. The output measured voltage Vdmy is fed to the voltage comparator 90. The dummy load circuit 91 thus designed effectively simulates the charging operation of the drain line capacitance Cd and the LCD capacitance within the TFT panel 70.

The voltage comparator 90 is design to detect the charge/discharge state of the TFT panel 70, which is simulated by the dummy load circuit 91, through voltage comparison. The voltage comparator 90 generates a reference voltage Vref from selected one(s) of the received from the grayscale voltage generator 11, and compares the output measured voltage Vdmy received from the dummy load circuit 91 with the generated reference voltage Vref to develop the comparison result signal Vup.

Preferably, the drive voltage SRCd, which is fed to the dummy load circuit 91, is driven to one of the grayscale voltages $V_0$ to $V_{63}$ which requires the longest time to charge the drain line and the LCD capacitance within the TFT panel 70. In the case that the LCD driver adopts a frame inversion drive technique, for example, the drive voltage SRCd is driven to the grayscale voltage $V_0$ and $V_{63}$, alternately, every two frames or every two horizontal periods. The capacitor 93 within the dummy load circuit 91 is charged or discharged every when the pixel data Dd received by the pixel drive circuitry 6*d* is updated, and the charged/discharged state of the capacitor 93 is explicitly represented as the output measured voltage Vdmy received from the dummy load circuit 91.

In order to detect that the output measured voltage Vdmy is driven to a targeted voltage range, the voltage comparator 90 receives selected one(s) of the grayscale voltage generator 11, and develops the reference voltage Vref from the received grayscale voltage(s).

In one embodiment in which the LCD driver adopts the inversion drive technique, the dummy load circuit 91 is alternately driven to the grayscale voltages $V_0$ and $V_{63}$, which are the lowest and highest ones of the grayscale voltages $V_0$ to $V_{63}$, every two horizontal periods, and the voltage comparator 90 receives the grayscale voltages $V_0$ and $V_{63}$ from the grayscale voltage generator 11. During a horizontal period during which the dummy load circuit 91 is pulled up to the grayscale voltage $V_{63}$ by the pixel drive circuitry 6*d*, the voltage comparator 90 defines the reference voltage Vref as being the grayscale voltage $V_{63}$ minus $\alpha$. During another horizontal period during which the dummy load circuit 91 is pulled down to the grayscale voltage $V_0$, the voltage comparator 90 defines the reference voltage Vref as being the grayscale voltage $V_0$ plus $\alpha$. The voltage comparator 90 compares the output measured voltage Vdmy with the reference voltage Vref such defined to develop the comparison result signal Vup.

In an alternative embodiment, the dummy load circuit 91 is alternately driven to the grayscale voltages $V_0$ and $V_{63}$, which are the lowest and highest ones of the grayscale voltages $V_0$ to $V_{63}$, every two horizontal periods, and the voltage comparator 90 receives the grayscale voltages $V_1$ and $V_{62}$, the grayscale voltage $V_1$ being higher than and the closest to the grayscale voltage $V_0$, and the grayscale voltage $V_{62}$ being lower than and the closest to the grayscale voltage $V_{63}$. During a horizontal period during which the dummy load circuit 91 is pulled up to the grayscale voltage $V_{63}$ by the pixel drive circuitry 6*d*, the voltage comparator 90 defines the reference voltage Vref as being the grayscale voltage $V_{62}$. During another horizontal period during which the dummy load circuit 91 is pulled down to the grayscale voltage $V_0$, the voltage comparator 90 defines the reference voltage Vref as being the grayscale voltage $V_1$. The voltage comparator 90 compares the output measured voltage Vdmy with the reference voltage Vref such defined to develop the comparison result signal Vup.

The output control circuit 86 and the gamma control circuit 84 are responsive to the comparison result signal Vup. The output control circuit 86 refers to the comparison result signal Vup to determine the timing when the switch drive signal SW_ON is deactivated, in response to the timing control signals CC. Correspondingly, the gamma control circuit 84 refers to the comparison result signal Vup to determine the timings when the gamma control signal GAMP_ON and the gamma switch control signal GSW_On are respectively deactivated, in response to the timing control signals CC.

It should be noted that the dummy load circuit 91 may be integrated within the TFT panel 70. This allows simulating the electrical properties of signal lines between the TFT panel 70 and the LCD driver, achieving more precise simulation.

Figure 9:
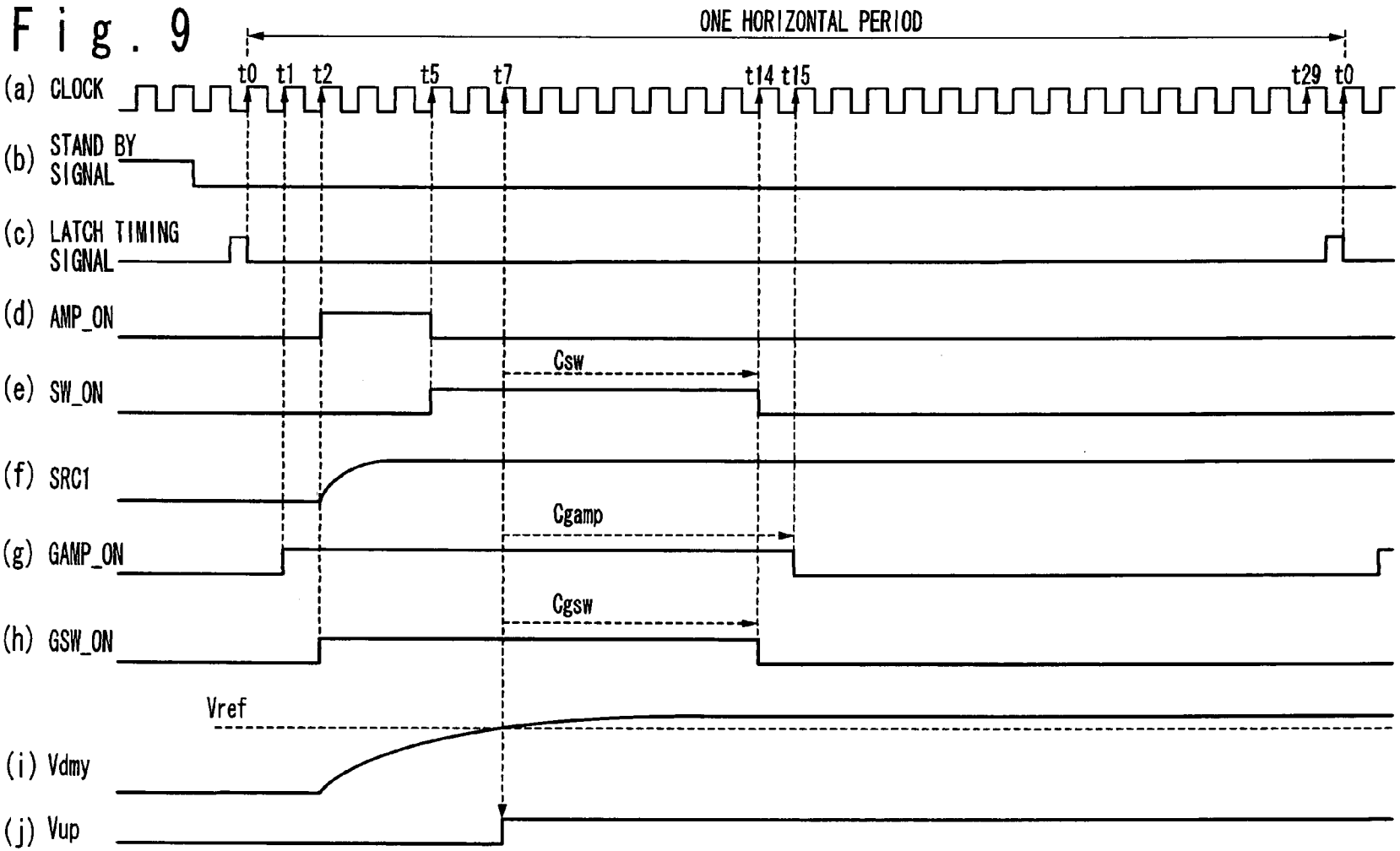
FIG. 9 is a timing chart illustrating an exemplary operation of the LCD driver in the third embodiment.

FIG. 9 is a timing chart illustrating an exemplary operation of the LCD driver in this embodiment, especially illustrating the operations of the grayscale voltage generator 11, and the pixel drive circuitries 61 and 6*d*. FIG. 9(*a*) illustrates the waveform of the clock signal of the timing control signals CC developed by the timing control circuit 81, and FIG. 9(*b*) illustrates the waveform of the standby signal SB, which is externally provided. FIG. 9(*c*) illustrates the waveform of the latch timing signal L, which is developed by the timing control circuit 81, and FIG. 9(*d*) illustrates the waveform of the amplifier drive signal AMP_ON developed by the output control circuit 86. FIG. 9(*e*) illustrates the waveform of the switch drive signal SW_ON, and FIG. 9(*f*) is the waveform of the drive voltage SRC1 developed by the drive circuit 31. FIG. 9(*g*) illustrates the waveform of the gamma control signal GAMP_ON developed by the gamma control circuit 84. FIG. 9(*h*) illustrates the waveform of the gamma switch control signal GSW_ON developed by the gamma control circuit 83. Finally, FIG. 9(*i*) illustrates the waveform of the output measured voltage Vdmy outputted from the dummy load circuit 91, and FIG. 9(*j*) illustrates the waveform of the comparison result signal Vup developed by the voltage comparator 90.

The LCD driver starts image display operation in response to the deactivation of the standby signal SB, which is externally provided. In this embodiment, one horizontal period initiates at a clock time t0, that is, at the timing just after the latch timing signal L is activated to latch the pixel data D1 into the latch circuit 51.

The gamma control signal GAMP_ON is activated by the gamma control circuit 83 at a clock time t1 in response to the GAMP_ON activation setting value stored in the register 88. The timing of the activation of the gamma control signal GAMP_ON is determined so that the grayscale voltages $V_0$ to $V_{63}$ are stably developed on the nodes of the serially-connected resistors 15 before the initiation of the "amplifier driving" in response to the activation of the amplifier drive signal AMP_ON. The activation of the gamma control signal GAMP_ON allows the amplifiers 14 to be activated, and the nodes of the serially-connected resistors 15 are driven to the desired grayscale voltages $V_0$ to $V_{63}$.

At a clock time t2, when the grayscale voltages $V_0$ to $V_{63}$ are stably developed on the nodes of the serially-connected resistors 15, the gamma control circuit 84 activates the gamma switch control signal GSW_ON in response to a GSW_ON activation setting value stored in the register 88. In response to the activation of the gamma switch control signal GSW_ON, the switches 18 are turned on, and the grayscale voltage generator 11 starts outputting the grayscale voltages $V_0$ to $V_{63}$ on the grayscale signal lines 19. In the meanwhile, the switches within the grayscale level selector 21 are selected in response to the pixel data D1 latched by the latch circuit 51. Selected one of the grayscale voltages $V_0$ to $V_{63}$, which is referred to as the selected grayscale voltage SL1, is fed to the drive circuit 31 from the grayscale level selector 21.

At the clock time t2, the amplifier drive signal AMP_ON is additionally activated by the output control circuit 86 in response to the AMP_ON activation setting value stored in the register 88. In response to the activation of the amplifier drive signal AMP_ON, the switch 31*b* is turned on to connect the output of the amplifier 31*a* with the associated drain line within the TFT panel 70. The amplifier 31*a* develops the drive voltage SRC1 corresponding to the selected grayscale voltage SL1 to charge the drain line capacitance 75 and the LCD capacitance 73 within the associated pixel with the associated TFT 71 turned on. The drive voltage SRC1 is pulled up and stabilized to the selected grayscale voltage SL1 as shown in FIG. 9(*f*).

In the meantime, as shown in FIG. 9(*i*), the dummy load circuit 91 is driven with the drive voltage SRCd, and the capacitor 93 within the dummy load circuit 91 starts to be charged.

At the clock time t5, the amplifier drive signal AMP_ON is deactivated to turn off the switch 31*b*, and the switch drive signal SW_ON is activated to turn on the switch 31*c*. This allows the LCD driver to switch the drive operation from the amplifier driving to the switch driving.

After the LCD capacitance 73 is fully charged, the TFT 71 is turned off. In the meantime, the capacitor 93 within the dummy load circuit 91 is also charged sufficiently, and the output measured voltage Vdmy is increased to exceed the reference voltage Vref. In response to the output measured voltage Vdmy exceeding the reference voltage Vref, the comparison result signal Vup is activated.

The output control circuit 86 and the gamma control circuit 84 are triggered by the activation of the comparison result signal Vup, and start counting clock cycles to determine the deactivation timings of the switch drive signal SW_ON, the gamma control signal GAMP_ON, and the gamma switch control signal GSW_ON.

More specifically, the switch drive signal SW_ON is deactivated by the output control circuit 86 at a clock time t14 when the output control circuit 86 counts a predetermined number of the clock cycles after the comparison result signal Vup is activated, the predetermined number being equal to the SW_ON extra clock cycle setting value (Csw) stored in the register 88. In response to the deactivation of the switch drive signal SW_ON, the switch 31*c* is turned off.

Correspondingly, the gamma switch control drive signal GSW_ON is deactivated by the gamma control circuit 84 at the clock time t14 when the gamma control circuit 84 counts a predetermined number of the clock cycles after the comparison result signal Vup is activated, the predetermined number being equal to the GSW_ON extra clock cycle setting value (Cgsw) stored in the register 88. In response to the deactivation of the gamma switch control signal GSW_ON, the switches 18 within the grayscale voltage generator 11 are turned off to electrically disconnect the grayscale signal lines 19 from the serially-connected resistors 15.

Furthermore, the gamma control drive signal GAMP_ON is deactivated by the gamma control circuit 84 at a clock time t15 when the gamma control circuit 84 counts a predetermined number of the clock cycles after the comparison result signal Vup is activated, the predetermined number being equal to the GAMP_ON extra clock cycle setting value stored in the register 88. In response to the deactivation of the gamma control signal GAMP_ON, the grayscale voltage generator 11 is deactivated, that is, the amplifiers 14 are deactivated with the output thereof set high-impedance and the switch 16 is turned off to stop feeding the power source voltage $V_H$-$V_L$ to the serially-connected resistors 12. This effectively reduces the current flow through the grayscale voltage generator 11, and thereby reduces the power consumption thereof.

As thus described, the LCD driver in this embodiment simulates the electrical behavior of the TFT panel 70 by the dummy load circuit 91, and appropriately determines the deactivation timings of the switch drive signal SW_ON, the gamma switch control signal GSW_ON, and the gamma control signal GAMP_ON. This effectively eliminates the influence of characteristics variations of the pixel drive circuitry 61, 62, . . . and 6*n*, resulting from the manufacture variations and the operating environment.

It is apparent that the present invention is not limited to the above-described embodiments, which may be modified and changed without departing from the scope of the invention.

What is claimed is:

1. A display panel driver comprising:

a grayscale voltage generator configured to develop a set of different grayscale voltages corresponding to grayscale levels of pixels within a display panel; and a plurality of grayscale selector driver circuits each of which is responsive to pixel data to select one of said grayscale voltages, and to provide a drive voltage corresponding to said selected one of said grayscale voltages for a selected pixel within said display panel, said grayscale selector driver circuits each comprising an amplifier and first and second switches, said first switch connecting an output of said amplifier to said selected pixel within said display panel, and said second switch connecting said one of said grayscale voltages to said selected pixel within said display panel, wherein said grayscale voltage generator is allowed to output said set of grayscale voltages during a first period within a horizontal period, and prohibited from outputting said set of grayscale voltages during a second period within said horizontal period, wherein said grayscale voltage generator includes:

first serially-connected resistors for generating different voltages through voltage dividing;

a set of amplifiers receiving said different voltages, respectively, and developing a set of bias voltages through voltage follower operation;

second serially-connected resistors receiving said bias voltages on nodes thereof and developing said set of grayscale voltages through voltage dividing;

a third switch for feeding a power supply voltage to said first serially-connected resistors, and wherein said grayscale voltage generator stops outputting said set of grayscale voltages through turning off said third switch, and placing outputs of said amplifiers into a high-impedance state.

2. The display panel driver according to claim 1, further comprising:

a gamma control circuit controlling said grayscale voltage generator, wherein said gamma control circuit is responsive to an externally-provided standby signal asynchronous with said horizontal period to prohibit said grayscale voltage generator from outputting said set of grayscale voltages; and wherein said gamma control circuit controls initiation and termination of said first period.

3. The display panel driver according to claim 1, further comprising:

a gamma control circuit controlling said grayscale voltage generator, wherein each of said grayscale selector driver circuits stops providing said drive voltage at a certain timing within said horizontal period, and wherein said gamma control circuit prohibits said grayscale voltage generator from outputting said set of grayscale voltages simultaneously with or just after said certain timing.

4. The display panel driver according to claim 1, wherein said grayscale voltage generator additionally includes a set of output switches connected between said second serially-connected resistors and said grayscale selector driver circuit.

5. The display panel driver according to claim 4, wherein said output switches are turned off before said grayscale voltage generator stops developing said grayscale voltages.

6. The display panel driver according to claim 4, wherein said output switches are turned off after each of said grayscale selector driver circuits stops providing said drive voltage for said display panel.

7. The display panel driver according to claim 1, further comprising:

a dummy load circuit including a capacitive element;

a dummy grayscale selector driver circuit design to select one of said grayscale voltages, and to provide a drive voltage corresponding to said selected one of said grayscale voltages for said dummy load circuit; and a voltage comparator receiving an output measured voltage developed across said capacitive element and selected one(s) of said set of grayscale voltages from said grayscale voltage generators, wherein said voltage comparator compares said output measured voltage with a reference voltage generated from said set of grayscale voltages to develop a comparison result signal, and wherein said grayscale voltage generators stops developing said set of grayscale voltages in response to said comparison result signal.

8. The display panel driver according to claim 1, wherein a duration of said first period within said horizontal period is the same for all values of said grayscale voltages of said set of different grayscale voltages.

9. The display panel driver according to claim 1, wherein said second period within said horizontal period occurs sequentially after said first period within said horizontal period.

* * * * *